US010943570B2

(12) United States Patent
Rundle

(10) Patent No.: US 10,943,570 B2
(45) Date of Patent: Mar. 9, 2021

(54) DRUM BRUSH WITH ROD

(71) Applicant: David Chappell Rundle, Burlington (CA)

(72) Inventor: David Chappell Rundle, Burlington (CA)

( * ) Notice: Subject to any disclaimer, the term of this patent is extended or adjusted under 35 U.S.C. 154(b) by 0 days.

(21) Appl. No.: 14/132,378

(22) Filed: Dec. 18, 2013

(65) Prior Publication Data

US 2015/0170620 A1 Jun. 18, 2015

(51) Int. Cl.
*G10D 13/00* (2020.01)

(52) U.S. Cl.
CPC ..... *G10D 13/003* (2013.01)

(58) Field of Classification Search
CPC ..... G10D 13/003; G10D 3/00; Y10T 16/466; Y10T 29/4957; G10H 2220/185; B25G 1/102; B27L 9/00; B29C 63/42; B29L 2031/463; G01B 5/02
USPC ..... 84/422.4
See application file for complete search history.

(56) References Cited

U.S. PATENT DOCUMENTS 4,559,860 A * 12/1985 Cordes ..... 84/422.4
4,590,839 A * 5/1986 Liedtke et al. ..... 84/422.4

* cited by examiner

*Primary Examiner* — Kimberly R Lockett

(57) ABSTRACT

A drum brush comprising a tube with slot, a plurality of wire bristles, a rod and O-ring, where the said bristles are at least partially within said tube in which portions of bristles extend outwardly from one end of tube, the end of casing from which the bristles extend is partially flattened to hold the bristles in position. The tube has a slot, its relative position is perpendicular and near to the end from which the bristles extend. A rod of a diameter such that when inserted into the said slot is held in position and adjustable in length by sliding in and out of the tube. The said O-ring is slid over the tube and rod, its function is used to adjust the height or relative distance of the said rod to that of the bristles.

16 Claims, 1 Drawing Sheet

DRUM BRUSH WITH ROD

BACKGROUND OF THE INVENTION

1. Field of Invention

The present invention relates to drum sticks as used for musical instruments and, more particularly, to a combination drum brush and rod which can be converted from a conventional or traditional drum brush to one with a rod centered above and running parallel to the brush bristles. The drum brush tube or handle area has a slot into which a rod can be inserted. The rod can be positioned to an area directly above the brush bristles. The rod is completely removable or can be adjusted in relative length by the amount it is in or out of the tube. The rod has a bead which can be adjusted or repositioned or removed as desired.

2. Description of the Prior Art

There are two broad categories of drumsticks—the stick type and the brush type. Typically, the stick type drumstick is constructed of wood and is elongated and cylindrical in shape with a ball-like head formed at one end. The end of the stick with the ball-like head is used to produce a hard and crisp sound when striking a drum. The brush type drumstick, or drum brush, is typically constructed of thin metal wire filaments which are secured to one end of a tubular handle. The wire filaments, or bristles, are pliable and produce a soft, jazzy, swish-like sound when striking a drum. Stick type drumsticks can be further categorized into one of two subcategories. The first consists of variations of a single elongated stick with a ball-like head formed at one end. Examples from this group include U.S. Des. Pat. No. 436,616 to Kaiser, U.S. Pat. No. 4,114,503 to Petillo, U.S. Des. Pat. No. 278,634 to Anderson, and the German patent DE3902429 to Rau. This type of drumstick is limited in that the type of sound it produces and cannot be varied, nor can it produce a blended sound, i.e., a sound produced when more than one type of stick simultaneously strikes a drum. Instead it is limited to producing one type of sound, a clear and crisp percussive sound. The second subcategory of stick type drumsticks consists of those that are actually bundles of sticks. Typically, a drumstick in this subcategory is constructed of a plurality of cylindrically-shaped wooden rods secured to a wooden handle. Examples from this group include U.S. Pat. No. 4,535,671 to Stromberg et al., U.S. Pat. No. 4,570,527 to Pruitt, and U.S. Pat. No. 6,002,077 to Nicolosi. Due to the interaction of the rods when striking a drum, this type of drumstick typically provides a percussive sound that differs from that of a single stick drumstick. Additionally, as taught by the Nicolosi patent, the sound produced by this type of drumstick can be varied slightly by restricting movement among the rods with a slidable sleeve. By sliding the sleeve away from the handle, it increasingly acts to bind the rods together. However, although movement among the rods can be gradually restricted by binding the rods together, movement cannot be enhanced because the interstices between the rods are incapable of being increased. Notably, this type of drumstick is not capable of producing a blended sound. Drum brushes, which make up the second broad category of drumsticks, can also be further categorized into one of two subcategories. The first subcategory consists of traditional drum brushes, which are typically constructed of wire bristles secured to a handle. Examples from this group included U.S. Pat. No. 2,485,823 to Goldrich, and U.S. Pat. No. 3,420,134 to Cordes. Like the single stick type drumstick, the traditional drum brush is limited in that the sound it produces cannot be varied and it cannot produce a blended sound.

The second subcategory of drum brushes consists of those designed to produce a blended sound by allowing more than one material to simultaneously strike a drum. Examples of this group include U.S. Des. Pat. No. 281,785 to Balter et al. and U.S. Pat. No. 4,590,839 to Liedtke et al. The design patent to Balter shows what appears to be a single stick type of drumstick with bristles secured to the stick in a manner such that the bristles partially, surround the ball-like head of the stick. However, although this may allow for a blended sound it does not allow for variation of sound. Similarly, the patent to Liedtke discloses a drum brush on which pellets are attached to some of the bristles. The pellets are attached away from the ends of the bristles thereby allowing the user to strike a drum with only the bristles or with a combination of the bristles and pellets. In United States Patent (16) Patent N6.=U.S. Pat. No. 6,646,192 B1 Marsland et al. shows a combination drum brush and drumstick which can be converted from a conventional drum brush to one with a dowel centered within the brush bristles by slidably extending the dowel from the drum brush handle. Accordingly, the principal object of the invention is to allow a user more than one percussive sound at the same time or to vary the type of sound that is produced without having to, change hand technique or switch from a traditional drumstick to drum brush without having to put one stick down to pick up another.

It is with respect to U.S. Pat. Nos. 281,785, 4,590,839, and 6,646,192 B1 that this application and drum brush with rod design has further enhanced and altered the physical properties and playing characteristics inherent of these particular patents and as a result is an improved drum brush design. Although somewhat similar in nature it combines a traditional drum brush design with all the traditional playability expectations with an adjustable or removable rod that is not in amongst the wire bristles but situated above the wire bristles, the rod has an adjustable or removable bead, this combination of features provides a complete set of dynamic sound options without adversely affecting the weight distribution and no change in grip diameter.

By positioning the rod above the bristles, when a more audible focal point is desired, a primary function of the adjustable rod with an adjustable bead is to provide an audible note within the wash sound of the bristles, but not to make this the prime focus of the combined sound. By adjusting the bead position the user can increase or decrease its contribution in producing this audible focal point. Another objective and feature of this design can be realized by turning the brush so that the nylon rod comes in contact before the bristles, the quick reflex of the nylon allows the user to employ hand and finger technique at quick tempos with relative ease. Quick tempo techniques are generally very difficult to execute with a traditional drum brush. The user can also limit the amount of brush contact with the playing surface by positioning the adjustable rod and bead, and by predetermining the side which the bristles are on relative to the rod and the playing surface.

Its design and simplicity allow this combination of brush and rod to be produced cost effectively within the current methods of drum brush production. These statements will become clear upon reviewing the specifications and drawing as follows.

SPECIFICATION

The following description outlines the specific procedures to make a drum brush with rod:

Step. 1: Tube as Depicted in FIG. 4

Materials: metal tube approximately ½ inch to ⅝ inch outside diameter (OD) tube with an inside diameter (ID) of 7/16 inch to 9/16 inch length approximately 7 inches long Procedure: Mill or drill a ¼ inch wide slot 14 approximately 1 inch in length at a position 1 inch from the end of the tube 4. Flatten the end 3 of the tube 4 nearest the slot 14 at 90 degrees to the longitudinal axis of the slot and tube 4 creating area as depicted in FIG. 6.

Step 2: Bristles as Depicted in FIG. 1

Materials: 5.5 inch long filaments, ferrule, epoxy, foam tape

Procedure: A plurality of bristles or filaments 1 are disposed within the tube 4 and protrude outwardly of the handle through the flattened opening 3. The filaments 1 may be constructed of metal or a monofilament nylon or any other suitable plastic material. The number of filaments or bristles 1 employed into the drum brush construction shown in FIG. 3 is sufficient in number to fill the flat area opening 3. The filaments or bristles 1 are substantially equal length and the ends of the bristles 3 which are disposed within the handle are held in a ferrule 2. The number of filaments or bristles 1 is usually sufficient to provide a tight fit within the ferrule 2, but a suitable adhesive is usually applied within the ferrule 2 to securely hold the ends of the filaments or bristles 1 therein. The ferrule 2 is crimped and flattened. The filaments or bristles 1 are crimped at 90% to the ferrule 2 crimping so that they form a fan shape as depicted in FIG. 3. The ferrule 2 is fitted with a foam tape 18 to reduce unwanted rattle sound of metal to metal contact and to help produce a snug fit when inserted into the tube 4. The brush bristles 1 with ferrule 2 as depicted in FIG. 1 is inserted in to the end and positioned in the tube 4 so that ferrule 2 holding the brush flare extends only a short distance into the tube 4 as depicted in FIG. 1. The tube 4 is flattened at further to ensure a snug fit at area 3.

Step 3: Sleeve Covering, End Cap and Rod Installation

Materials: 7 inch rubber sleeve 5 7 1/16 inch ID, 8 inch×3/16 inch polycarbonate rod, nylon bead with 3/16 inch hole, 2⅛ inch OD, 2 'O' rings ⅛ inch ID Procedure: Slide rubber sleeve 5 covering over the tube and align with the front and rear edge of the tube 4 as depicted in FIG. 1. Place end cap 6 on end at 8 as depicted in FIG. 1. Feel with fingers for the slot 14 as depicted in FIG. 4 on the top of the tube and make a cut 13 in the rubber sleeve 5 the length of the slot 14 as depicted in FIG. 1. Spread the cut 13 and insert the polycarbonate rod 9 through the cut 13 and the slot 14. Place a small O-ring 11 on to the rod 9, slide the bead 10 onto the rod followed by another small O-ring 12. Slide larger O-rings 15, 16 and 17 from the end cap position onto the tube and slide up into position as depicted in FIG. 3.

Note: Additional drum brush with rod can be realized by changing the following in Step 1 and Step 3;

Materials: 2-6 inch to 8 inch×3/16 inch nylon rods, 2 beads and 4 O-rings

Step 1: option (1) position the slots 14 and 25 on opposite sides of the tube 4 approximately 1 inch back from one end of the tube. Flattened area at the end of the tube nearest slots 14 and 24 in the same longitudinal axis as slots 14 and 25 as depicted in FIG. 8.

Step 3: option (1) Place rubber sleeve 5 over top of the tube 4, feel for the slot 14 and slot 25 on both sides of the tube 4, make cuts 13 and 19 in the rubber sleeve 5 the length of the 2 slots 14 and 25. Spread the cut 13 and insert the nylon rod 9 through the cut 13 and slot 14. Spread the cut 19 and insert the nylon rod 21 through the cut 19 and slot 25 as depicted in FIG. 5. Slide a small O-ring 11 onto rod 9, slide bead 10 onto rod 9 and slide on small O-ring 12. Slide a small O-ring 23 onto rod 21, slide bead 22 onto rod 21 and slide on small O-ring 24. As depicted in FIG. 5. Slide larger O-rings 15, 16 and 17 from the end cap position onto the tube and slide up into position as depicted in FIG. 5.

Materials: 1-18 inch to 20 inch×3/16 inch nylon rod

Step 1: option (2) follow Step 1 option (1).

Step 3: option (2) As depicted in FIG. 7, place rubber sleeve 5 over top of the tube 4, feel for the slot 14 and slot 25 area on both side on the tube 4, make cuts in the rubber sleeve 5 the length of the 2 slots 14 and 25. Spread the cut 13 and insert one end of the nylon rod 9 through cut 13 and slot 14, spread the cut 19 and insert the other end of nylon rod 9 through cut 19 and slot 25. Slide larger O-rings 15, 16 and 17 from the end cap position 8 onto the tube and slide up into position.

SUMMARY OF THE INVENTION

The drumstick brush of the present invention is a drum brush of a traditional design comprising a tube casing, a plurality of wire bristles crimped together at one end within tube casing in which the said bristles extend outwardly from one end of said casing. The tube casing end from which the said wire bristles extend is flattened so that the bristles are in a flat configuration and fan outward from the casing. When lying on a flat surface the fanned bristles will lie parallel to the surface and the top side of the tube will be on the opposite side of its lying surface. The tube casing has a slot, herein after referred to as the slot. The slot is positioned on the said tube casing's said top side near the end where the said bristles extend outward. The drumstick brush of the present invention has a rod, herein after referred to as the 'rod'. The said rod is inserted into the slot of the tube casing. The said rod is moveable by pushing it farther in or pulling out of its position in the slot.

The said slot is positioned aft of the flattened area of the tube in the said top side and has a length and width which allow the rod to be inserted and remain snuggly in position but will also allow the rod to be repositioned to a desired length by pushing or pulling it in or out of the slot in the tube casing. The length of the rod is determined by the amount the rod is pushed into the inside of the tube casing. The rod has an overlying 'O' ring, its elastic properties aid in adjusting the height position of the rod extending over and above the wire bristles. The said 'O' ring is moveable to position the rod's height position over the wire bristles. For example as the 'O' ring or 'O' rings are moved forward towards the bristles, the rod will bend bringing it closer to the bristles. The rod has a bead positioned on it at a position outside of the tube casing. The said bead is adjustable in position and held in position by friction or by positioning 2 small tight fitting 'O' rings on the rod in front of and behind the bead. By moving these 2 small 'O' rings forward or backwards, the bead is held in a desired position on the rod and will contribute a focal point in sound definition.

By utilizing the features herein, the drummer percussionist can play the traditional wire brush; while having easy access to a clear audible and distinct contact sound of the rod or bead by merely increasing intensity of the stroke; the rod or bead will come in contact with the playing surface and blend the two sounds together. This feature is of particular advantage when the drummer percussionist plays on cymbals as the traditional wire drum brush sound tends to create a washy sound with very little distinct contact sound as would be heard with a single more solid focal point. The bead or rod provides a focal point within the wire brush and naturally produces a clear audible note on the cymbal. This note can be increased or decreased in intensity by positioning the rod or adjusting the bead position on the rod or by repositioning the larger 'O' rings that hold and adjust the height of the rod over the bristles. The player can also turn the brush so the bead or rod come in contact with the playing surface prior to the wire bristles thus providing the most distinct note of this combination. This combination of adjustable rod and bead with the traditional brush provides a unique combination of sound and dynamics. These combinations were not previously available in prior art forms of drumstick type brushes nor are they available within the current array of bundled rods, wire bristles or wooden drumsticks. In addition to the audible clarity that the rod or bead provides when coming in contact with the playing surface, they also enhance the rebound. For example; the nature of wire bristles in the format of traditional drum brushes do not provide an optimum rebound. In fact, because of the small diameter of the individual wire bristles relative to their weight and length the rebound they provide is near minimal. The rod chosen in polycarbonate or nylon is very resilient and has very quick reflex, snapping back to its straight length position very quickly. By incorporating the rod in a versatile adjustable position within the traditional wire drum brush it provides a superior rebound over the stand alone traditional wire drum brushes. These characteristics of the drumstick brush with rod produce superior rebound allowing more finesse, speed and dynamic sound control over that of other traditional wire drum brushes.

BRIEF DESCRIPTION OF THE DRAWINGS

In the drawings wherein like numerals are used to depict like parts throughout the same.

DESCRIPTION OF THE PREFERRED EMBODIMENTS

Figures 1, 2, 3, 4, 5, 6, 7, 8, 9, 10:
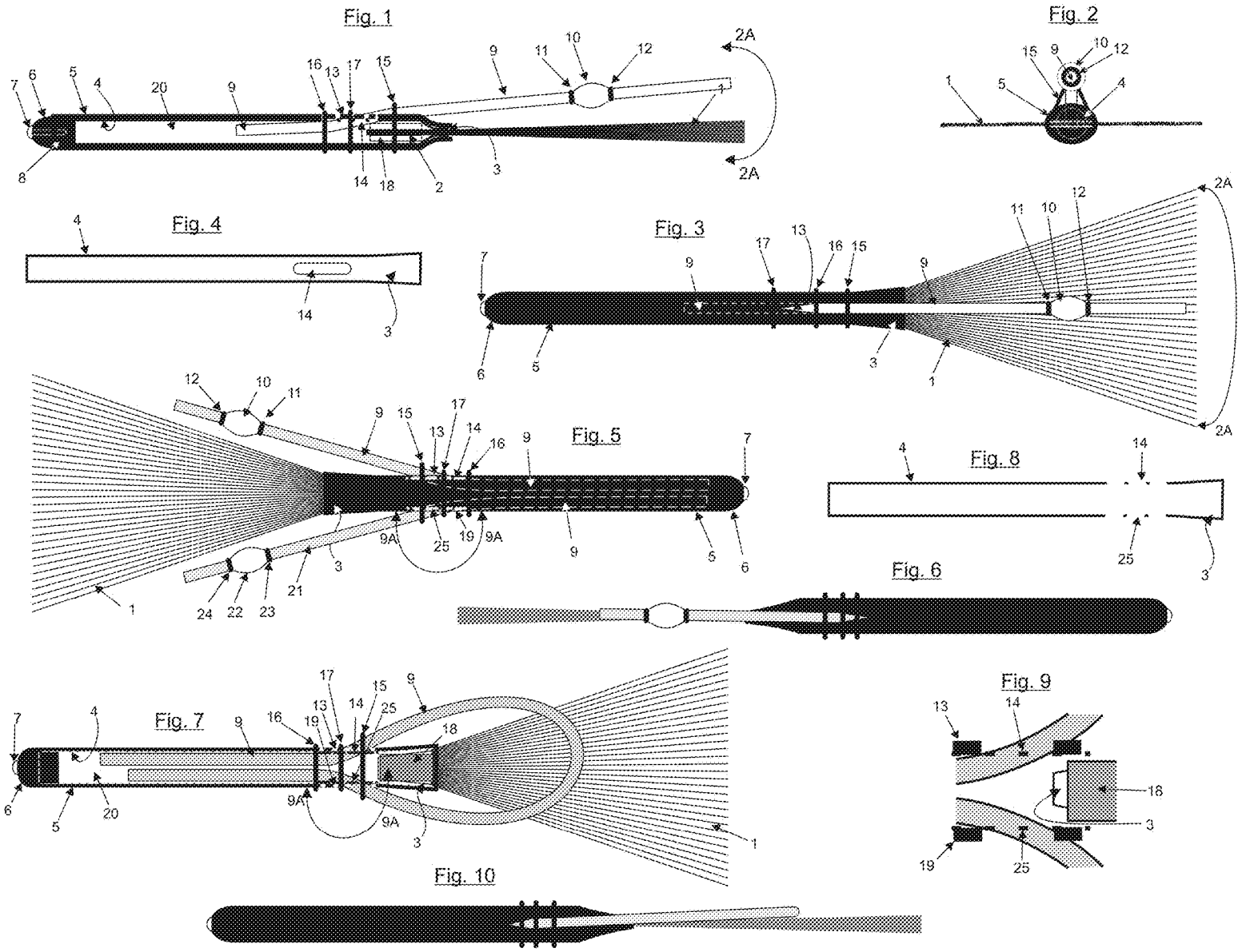
FIG. 1 cross-sectional side view of the drum brush with rod.
FIG. 2 is front view of the drum brush with rod at 2A-2A of FIG. 1 and FIG. 3.
FIG. 3 is an overhead view of drum brush with rod.
FIG. 4 is overhead view of the tube in FIG. 1
FIG. 5 is an overhead view of an alternate version utilizing a double slotted tube and 2 rods.
FIG. 6 is a side view of the alternate version depicted in FIG. 5
FIG. 7 is an overhead cross-sectional view of an alternate version utilizing a double slotted tube and a longer rod inserted into both side slots.
FIG. 8 is an overhead view of the tube used in FIG. 5 and FIG. 7
FIG. 9 is an enlarged overhead view of the area 9A in FIG. 7 and FIG. 5
FIG. 10 is a side view of the alternate version depicted in FIG. 7

FIG. 1 depicts a cross sectional side view of one version of the drum brush with rod. The brush filaments 1 are inserted into a ferrule 2 and flared and crimped to ensure a secure fit, an epoxy can be used to increase the connection between these two components. The brush filaments can be comprised of metal wire or synthetic strands. Foam tape 18 is added to the ferrule to reduce and eliminate rattle between the ferrule and the tube. The ferrule is comprised of metal. The slot 14 is made starting approximately one inch from one end of the tube. The tube is flattened at 3 such that the flatten area is perpendicular to the slot 14. The brush filaments with ferrule 2 and foam tape 18 are inserted brush end first into the tube at 8 and slid to the forward position through the area at 3 so that the brushes flair out in a fanned configuration when exiting the tube 4. The tube 4 is further flattened at 3 to ensure a secure fit between the tube and the brush filaments 1 in a fanned configuration 1. The end cap 6 is inserted into the end 8, an optional metal type rivet with domed head 7 is drilled into the end cap 6. The outer sleeve 5 is slid over the tube. The cut 13 is made in the outer sleeve 5. The rod 9 is inserted through the cut 13 and slot 14 into the tube 4 space 20. The small 'O' ring 11, the bead 10 followed by the 'O' ring 12 are then placed onto the rod 9 and slid to a predisposed position as depicted in the FIG. 1 and in the overhead view in FIG. 3.

The 3 large 'O' rings 15, 16, 17 are slid over the cap 6 and slid into a position over the outer sleeve 5 or the rod 9 as depicted in FIG. 1, FIG. 2 and FIG. 3.

FIG. 2 depicts a head on view of the embodiment at 2A of FIG. 1 and FIG. 3 showing the brush filaments 1 in a fanned out configuration with the rod 9 with bead 10 at a position centered and above the brush bristles 1.

FIG. 4 depicts an overhead view of the tube 4, the material composition of the tube can be one of metal such as aluminum or brass or a synthetic material such as polycarbonate. The slot 14 shown in FIG. 4 is milled or drilled at its position prior to further assembly of the embodiment depicted in FIG. 1. The slot is approximately ¼ inch wide and 1 inch long. It is positioned approximately 1 inch back from the one end of the tube 4. An initial flattening of the area 3 is also done at the end near the slot 14. The flatten area 3 is perpendicular to the slot as depicted in FIG. 4.

FIG. 5 depicts another embodiment in which the tube 4 depicted in FIG. 8 in which the sleeve 5 has been slid over the tube 4 and cuts 13 and 19 have been cut into position at the midpoint of slots 14 and 25. Rod 9 is inserted through cut 13 and slot 14 and rod 21 is inserted through cut 19 and slot 25. Optional 'O' rings 11, 12 and bead 10 are shown in a predisposed position on rod 9 and optional 'O' rings 23, 24 and bead 22 are shown in a predisposed position on rod 21.

FIG. 6 depicts a side view of the embodiment shown in FIG. 5.

FIG. 7 depicts yet another embodiment in which one longer nylon rod 9 inserted though cut 13 and slot 14 and its opposite end is inserted through cut 19 and slot 25.

FIG. 8 depicts the tube 4 with slots 14 and 25 that is used in the embodiments of the invention as depicted in FIG. 5 and FIG. 6 and again in FIG. 7 and FIG. 10.

FIG. 9 is an enlargement showing the cuts 13 and 19 and slots 14 and 25 of the area 9A shown in FIG. 5 and FIG. 7.

It will be appreciated that the rods 9 and 21, depicted in FIG. 1, FIG. 2, FIG. 3, FIG. 5 and FIG. 7 of the drum brush with rod invention may be fabricated of any synthetic material such as polypropylene, nylon, polycarbonate PVC or ABS plastics which has the required degree of stiffness and resilience desired to form sufficient bounce and strength as intended for this invention. The diameter of the rods may vary in accordance with the width of the slots. It will be appreciated that the width and length may vary to suit the diameter and rod sizing. It will also be appreciated that the brush filaments may be comprised of suitable wire comprised of brass, steel or nylon. The over lying outer sleeves can be comprised of suitable rubber, PVC or shrink material. It will also be realized that the 'O' rings and beads as depicted are moveable and removable from their predisposed positions and therefore become an optional feature of the invention. The rod or rods as depicted are moveable and removable from their respective positions.

The embodiments of the invention in which an exclusive property or right is claimed are defined as follows:

1. A drum brush percussion device comprising;

a ½ inch diameter tube handle approximately 7 inches long and having one end thereof provided with a substantially oval-shaped opening and having;

a ¼ inch wide slot approximately 1 inch long and having;

a plurality of filaments approximately 5 ½ inches long of substantially equal length and having one end thereof extending into the tube handle through said oval-shaped opening and means for holding the said one end of said filaments together within the said tube handle to prevent the complete withdrawal of said filaments through said opening and having;

a 3/16 inch diameter rod approximately 10 inches long and having;

a bead with a 3/16 inch center hole.

2. The plurality of filaments recited in claim 1 fan out from the said tube handle in a substantially planar configuration.

3. The slot as recited in claim 1 is positioned in the tube handle approximately 1 inch from the end holding the plurality of filaments and said slot is substantially midway above the said fan of filaments.

4. The rod as recited in claim 1 is inserted into the said slot.

5. The bead as recited in claim 1 is inserted onto the said rod.

6. A drum brush percussion device comprising;

A ½ inch diameter tube handle approximately 7 inches long and having one end thereof provided with a substantially oval-shaped opening and having;

two ¼ inch wide slots approximately 1 inch long and having;

a plurality of filaments approximately 5 ½ inches long of substantially equal length and having one end thereof extending into the tube handle through said oval-shaped opening and means for holding the said one end of said filaments together within the said tube handle to prevent the complete withdrawal of said filaments through said opening and having;

a 3/16 inch diameter rod approximately 18 inches long.

7. The plurality of filaments recited in claim 6 that fan out from the said tube handle in a substantially planar configuration.

8. The two slots as recited in claim 6 said slots are positioned in the tube handle approximately 1 inch from the end holding the said plurality of filaments such that the said slots are located on opposite sides from each other on the said tube handle and align in the same a horizontal plane of the plurality of filaments.

9. The rod as recited in claim 6 wherein one end of the said rod is inserted into one of the said slots and its opposite end is inserted into the opposite other slot.

10. The filaments as recited in claim 6 are selected from a group consisting of plastic or metal wire.

11. The rod as recited in claim 1 is selected from a group consisting on nylon or polycarbonate.

12. The filaments as recited in claim 1 are selected from a group consisting of plastic or metal wire.

13. The rod as recited in claim 1 is selected from a group consisting on nylon or polycarbonate.

14. The rod as recited in claim 6 is selected from a group consisting of nylon or polycarbonate.

15. The filaments as recited in claim 6 are selected from a group consisting of plastic or metal wire.

16. The rod as recited in claim 6 is selected from a group consisting of nylon or polycarbonate.

* * * * *